United States Patent [19]

Bernard

[11] Patent Number: 4,830,895

[45] Date of Patent: May 16, 1989

[54] HEAT SHRINK PACKAGE HANDLE

[75] Inventor: Emile C. Bernard, Rueil Malmaison, France

[73] Assignee: Minnesota Mining and Manufacturing Company, St. Paul, Minn.

[21] Appl. No.: 76,204

[22] Filed: Jul. 21, 1987

Related U.S. Application Data

[62] Division of Ser. No. 785,073, Oct. 7, 1985, Pat. No. 4,700,528.

[30] Foreign Application Priority Data

Oct. 12, 1984 [FR] France ..... 84 15652

[51] Int. Cl.[4] ..... B27N 5/02

[52] U.S. Cl. ..... 428/34.2; 206/432; 428/34.3; 428/35.1

[58] Field of Search ..... 428/35; 206/432

[56] References Cited

U.S. PATENT DOCUMENTS

| | | | |
|---|---|---|---|
| 3,111,221 | 11/1963 | Chapman et al. | 206/65 |
| 3,353,326 | 11/1967 | Becker | 53/24 |
| 3,387,702 | 6/1968 | Reynolds et al. | 206/65 |
| 3,552,559 | 1/1968 | Kirby, Jr. | 206/65 |
| 3,557,516 | 10/1968 | Brandt | 53/14 |
| 3,834,525 | 9/1974 | Morgese et al. | 206/161 |
| 3,866,386 | 2/1975 | Ganz | 53/14 |
| 4,050,216 | 9/1977 | Stenberg | 53/14 |
| 4,269,314 | 5/1981 | Barrash | 206/428 |
| 4,294,058 | 10/1981 | Rensner | 53/413 |

FOREIGN PATENT DOCUMENTS 2136030 11/1972 France .

*Primary Examiner*—Edith Buffalow

*Attorney, Agent, or Firm*—Donald M. Sell; Walter N. Kirn; Leland D. Schultz

[57] ABSTRACT

A length of tape 3 is bonded to a heat shrinkable film 2, and the film 2 is weakened along the edges of a central portion of the length of tape 3. The film 2 is then wrapped around an article or articles, has its two opposite ends sealed together, and is heat shrunk around the article or articles causing access openings 6, 7 in the sheet in the weakened areas along the central portion of the tape that can then be used as a handle for the resultant package 1.

3 Claims, 2 Drawing Sheets

HEAT SHRINK PACKAGE HANDLE

This is a division of application Ser. No. 785,073 filed Oct. 7, 1985, U.S. Pat. No. 4,700,528.

TECHNICAL FIELD

The present invention relates to packaging various articles such as groups of beverage bottles, cans, or boxes with heat shrinkable plastic film.

BACKGROUND ART

Such packaging with heat shrinkable plastic film is relatively easily done at commercially acceptable speeds by automatic machines. The packages formed are economical, aesthetically pleasing and insure a purchaser that the package has not previously been opened.

Such packages do, however, need a handle to facilitae handling the package. The prior art has attempted to solve this problem by forming a harness around the package or by adhering a handle to it as with a pressure sensitive adhesive, or by cutting slots beside reinforced seam portions of the package after it is heat shrunk around the articles (see French Patent Publication No. 2,136,030). Such attaching of a handle, however, has required an additional operation after the wrapping operation, and such cutting of slots has not provided easy access to the portion of the seam that then provides the handle.

DISCLOSURE OF INVENTION

The present invention provides a method for forming packages with shrinkable film that has a handle by which the packages can be manipulated without requiring any additional operations on the packaging line in addition to the normal operations by which the heat shrinkable plastic film is applied and shrunk, which handle is strongly attached to the film, is well positioned and is easily accessible to a person wishing to carry the package.

According to the present invention there is provided a method for packaging at least one article in heat shrinkable film while forming at least one handle for carrying the resultant package, which method comprises the steps of (1) bonding a length of tape along its entire length to a sheet of heat shrinkable material; (2) weakening portions of the sheet along central portions of the longitudinal edges of the tape; (3) wrapping the article in the sheet of heat shrinkable material with the central portion of the tape at a location relative to the article at which the handle is desired; (4) sealing two opposite ends of the sheet together; and (5) heating the sealed sheet to a temperature sufficient to shrink the sheet onto the article so that openings are caused through the weakened portions of the sheet along the central portion of the tape which then provides the handle.

To adapt the method according to the present invention to production machinery it can further include providing a continuous strip of heat shrinkable material; bonding lengths of tape to the strip at spaced intervals to provide the bonding step; weakening portions of the strip along each of the lengths of tape to provide the weakening step; and cutting away a portion of the strip including one of the lengths of tape for use in the wrapping, sealing and heating steps.

The weakened areas along the central portion of the tape may be created by perforating, or by cutting, or by thinning the heat shrinkable sheet which may be done, for example, by pressing a heated blade against it or by imprinting dark lines on the heat shrinkable sheet which will be preferentially heated by the radiation that shrinks the film as is described in the French Pat. No. 1,314,184, incorporated herein by reference.

The tape may be bonded to the heat shrinkable sheet by any convenient means, but preferably is bonded by an appropriate adhesive, such as a pressure sensitive adhesive, by heat sealing or by ultrasonic welding.

The present invention also provides a packaging laminate adapted to be applied as a package for at least one article, the packaging laminate comprising a sheet of heat shrinkable plastic and at least one length of tape bonded to one surface of the sheet with the heat shrinkable sheet being weakened along central portions of the longitudinal edges of the tape. Preferably the sheet of shrinkable plastic is selected from the group consisting of polyolefines, biaxially-oriented polyvinylchloride and polyester; the tape backing is made of material selected from the group consisting of natural and synthetic fabrics, polyester, polypropylene, fiber reinforced film, stabilized polyvinylchloride, kraft paper, and reinforced cardboard; and the tape is bonded to the film with an adhesive.

Also provided by the present invention is a package comprising at least one article, a sheet of heat shrunk polymeric material around the article, a length of tape bonded to the surface of the polymeric material and retaining the polymeric material bonded to the tape in a relatively non-heat-shrunk condition, and openings in the heat shrunk polymeric material along a central portion of the tape so that the central portion of the tape adjccent the openings provides a handle for the package.

If desired, a package made according to the invention may have two handles (or more) located, for instance, on its two opposite top ends or on its two opposite sides, or diagonally across and crossed on the middle of its top surface.

If desired, end portions of the tape on each side of the central portion of the tape that provides handles, may go practically entirely around the package which may be necessary for relatively heavy packages.

The tape may be attached to either the inside or the outside of the heat shrinkable sheet with respect to the package, and may be used as printing location, for instance, for advertising purposes. Also, two lengths of tape may be attached opposite each other on the inside and the outside of the heat shrinkable sheet.

The application of the length of tape to the sheet of heat shrinkable film and the weakening of the film along the central portion of the tape may be easily done by automatic packaging machines using methods well known by those skilled in the art, particularly in the field of label application.

The close association between the tape handle and the packaging sheet ensures an excellent resistance to tensile and shearing forces.

Moreover, the formation of access openings for the handle from weakened lines by heat-shrinking the sheet restricts the formation of stress concentration notches along the edges defining the opening which can occur when an opening is cut into such film after it is heat shrunk.

BRIEF DESCRIPTION OF THE DRAWING

The present invention will be further described with reference to the accompanying drawing wherein like numbers refer to like parts in the several views, and wherein.

DETAILED DESCRIPTION

Figure 1:
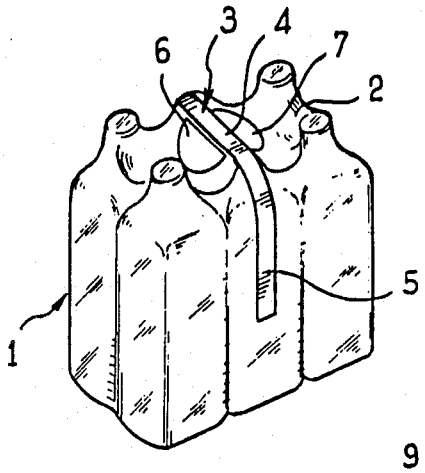
FIG. 1 is a perspective view of a first embodiment of a package made according to the present invention.
Figure 2:
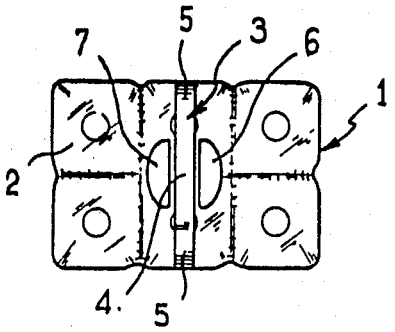
FIG. 2 is a top view of the package of FIG. 1.

Referring now to FIGS. 1 and 2, there is illustrated a package 1 according to the present invention containing six bottles, such as bottles of mineral water.

These six bottles are grouped and packed in a heat shrunk plastic sheet 2, such as a sheet of polyethylene of the type currently used for such packages.

At the middle of the package 1 is attached a length of tape 3, a central portion of which extends across the top of the package 1 and provides a handle 4 for the package 1, and the end parts 5 of which fix the handle 4 to the sheet 2. For most applications it is preferable that the tape 3 be made of a material that is relatively non-heat-shrinkable compared to the plastic sheet 2 before it is shrunk around the bottles when both the tape 3 and the sheet 2 are exposed to the temperatures at which the sheet 2 is normally shrunk.

On each side of the central portion of the length of tape 3 the heat shrunk sheet 2 has access openings 6 and 7 which allow a user's hand to grasp the handle 4.

As an example, one heat shrinkable plastic sheet material that can be used to form the package 1 is that sold under the commercial designation "Polyethylene, Film Lineaire 80 microns" by the French company REMY. Thermal treatment of this sheet material at 230–250 degrees C. for about 6 seconds with hot air or by infrared radiation causes it to shrink approximately 60 percent lengthwise of the sheet and 20 percent widthwise of the sheet. Thus it is advantageous, for most applications with this sheet, to arrange lengths of tape to be used as handles transversely to the length of such sheet material, however, the expected result in accordance to the present invention can also be obtained by arranging those lengths of tape in other orientations with respect to the length of such sheet material.

To package 6 plastic bottles of 1.5 to 2 liters of the type currently used for mineral water, a sheet size of 420 mm wide and having an appropriate length could be used.

Suitable materials to be used for the tape 3 include non-stretchable pressure sensitive adhesive coated tapes such as, for example, the tape reinforced with glass filaments running along its length sold by Minnesota Mining and Manufacturing Company (3M), Saint Paul, Minn. under the trade designation "Scotch Brand Filament Tape 898", or the tape sold by 3M under the trade designation "Scotch Brand Tape No. 351" which has a polyester film backing. Stretchable pressure sensitive adhesive coated tapes are also usable and may be preferred for some uses because of their shock absorbing properties. An example of such a stretchable tape is the tape having a polypropylene backing sold by 3M under the trade designation "8459 Scotch Brand Film Tape." The example tapes listed above are coated with rubber-resin adhesives which adhere very well to polyethylene sheet material.

Figure 3:
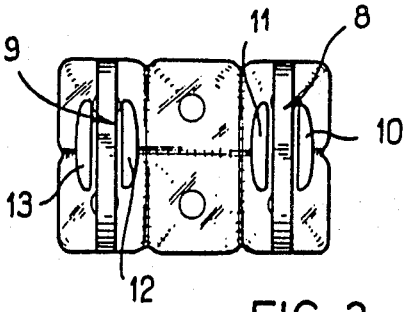
FIGS. 3, 4 and 5 are top views of second, third and fourth embodiments of packages made according to the present invention.

A second embodiment of a package according to the present invention is illustrated in FIG. 3 enclosing six bottles, and includes two lengths of tape forming handles 8, 9 having respectively on their two sides openings 10, 11, 12 and 13.

Figure 5:
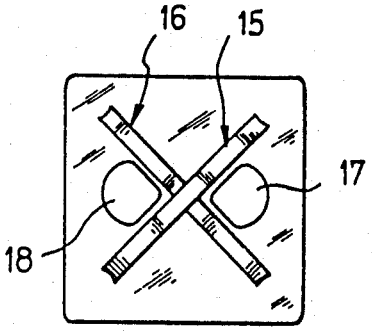
Figure 4:
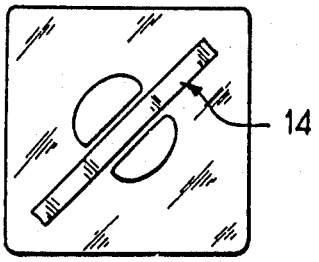

In a third embodiment of a package according to the present invention illustrated in FIG. 4, only one tape handle 14 is attached at a diagonal; whereas in a forth embodiment shown in FIG. 5 two tape handles 15, 16 are attached crosswise with their central portions forming a single handle with two openings 17, 18 at its sides.

Figure 6:
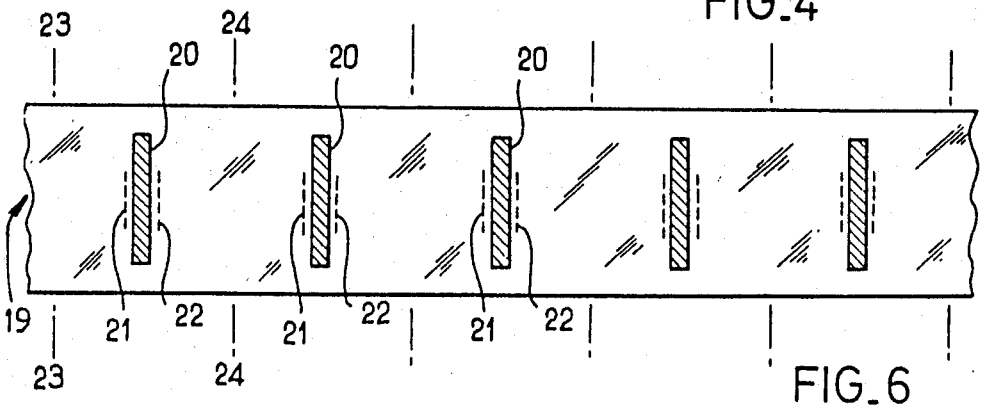
FIG. 6 is a fragmentary plan view of a packaging laminate according to the present invention.

FIG. 6 illustrates a packaging laminate according to the present invention including a heat shrinkable polymeric packaging film 19 having adhered to it at equally spaced intervals, transverse lengths of tape 20, and linear weakened portions 21 and 22 of the film 19 along central portions of the longitudinal edges of the tape 20.

The film 19 can be cut into equal pieces generally along the lines 23 and 24 and have the pieces applied around one or more objects by a standard packaging machine to form packages generally of the type shown in FIGS. 1 and 2.

The weakened lines 21, 22 may consist of perforations spaced from each other by approximately 2 to 3 millimeters, or incisions about 3 to 5 millimeters long spaced from each other by approximately 1 to 2 millimeters.

To package six bottles of mineral water containing 1.5 to 2 liters each, an adhesive tape 20 which is 25 millimeters wide and 40 to 45 centimeters long may be used. The weakened lines 21 and 22 may each be of about 10 centimeters long which makes a good length for the handle. The shrinking of the polyethylene film after the standard sealing of its ends may be done in approximately 6 seconds at 250 degrees C., such as in a heat shrinking force air oven of the type sold by the French Company TERMELEC S.A. The resultant packages will each have two halfmoon shaped openings each about 10 centimeters long and 5 to 7 centimeters wide which are located on opposite sides of the handle provided by a central portion of the length of tape 20.

Figure 7:
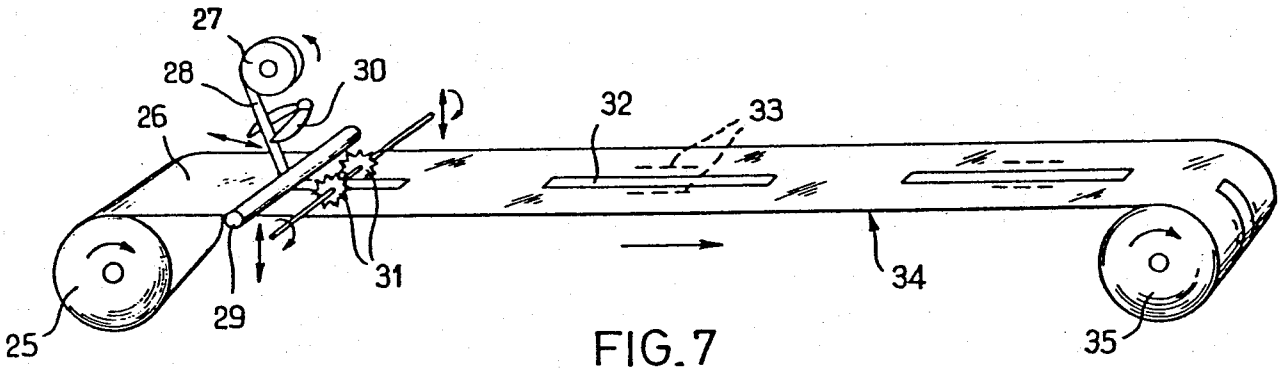
FIG. 7 is a schematic view in perspective illustrating a method for manufacturing a second embodiment of a packaging laminate according to the present invention.
Figure 8:
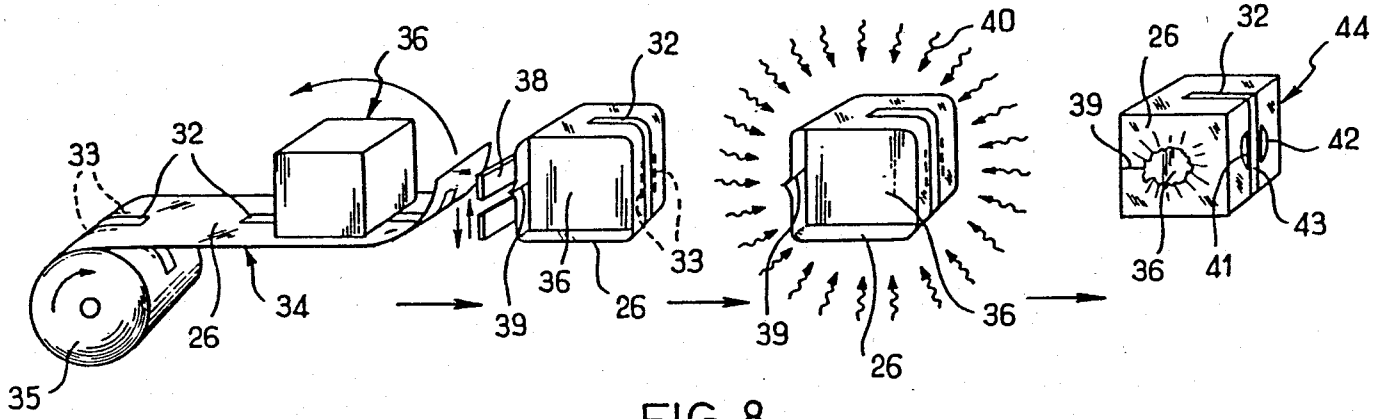
FIG. 8 is a schematic view in perspective illustrating a method according to the present invention for applying the packaging laminate of FIG. 7 to form packages according to the present invention.

FIGS. 7 and 8 sequentially illustrate a method according to the present invention for packaging at least one article 36 in heat shrinkable film 26 while forming at least one handle 43 for carrying the resultant package 44. FIG. 7 illustrates forming a packaging laminate according to the present invention and FIG. 8 illustrates forming packages according to the present invention using the packaging laminate made by the method shown in FIG. 7.

As is shown in FIG. 7, a rolled supply length 27 of pressure sensitive adhesive coated tape 28 is cut into desired lengths 32 by a knife 30 and the lengths 32 of the tape 28 are then applied at equal intervals along a sheet 26 of heat shrinkable polymeric material from a supply roll 25 by a roller 29, while two toothed wheels 31 are pressed against the film 26 to make two perforated lines 33 located on opposite sides of the lengths 32 of tape, and only along the future handles 43 to be formed by the central portions of the lengths 32 of the tape 43. The resultant packaging laminate 34 according to the invention is then wound into a roll 35 for storage or for direct use to form packages by the further method steps illustrated in FIG. 8.

As illustrated in FIG. 8, the packaging laminate 34 (including lengths 32 of tape adhered in spaced relationship along heat shrinkable film 26 and edged along their central portions with perforated lines 33 though the film 26) is wrapped around an article 36 to be packed so that one length 32 of tape will be positioned across the top of the package with its central portion at a desired location for the handle 43 to be formed. The laminate 34 wrapping around the article 36 is then sealed at 39 and simultaneously cut by a pair of thermo cutters 38. The assembly is then submitted to heat radiation 40 which causes the shrinking of the film 26 onto the article 36 and the formation of openings 41 and 42 at each side along the central portion of the length 32 of tape to form the handle 43 for the package 44.

As an example, the machines sold by 3M (USA) under the trade designation "3M Applicator No. T-645H" could be used to apply the lengths of tape on the heat shrinkable film and the single or double track bundling machines sold by the companies DOBOY (France) and KISTERS (Switzerland) could be used for forming the packages.

It will be understood by those skilled in the art that the present invention is not limited to the embodiments described above, but could be modified in many ways depending on the desired application without departing from the spirit of the invention. For example, the tape 28 applied in the method illustrated in FIG. 7 could be applied in a continuous length along the sheet 26 and could then be cut by the thermo cutters 38 along with the film 26.

Thus the scope of the present invention should not be limited to the structure described in the specification, but only to the structures recited in the claims and their equivalents.

I claim:

1. A packaging laminate adapted to be applied as a package for at least one article, said packaging laminate comprising a sheet of heat shrinkable plastic and at least one length of tape bonded to one surface of said sheet, said heat shrinkable sheet being weakened along central portions of the longitudinal edges of the tape.

2. A package laminate according to claim 1, wherein said sheet of heat shrinkable plastic is selected from the group consisting of polyolefines, biaxially-oriented polyvinylchloride and polyester; the tape is made of material selected from the group consisting of natural and synthetic fabrics, polyester, polypropylene, fiber reinforced film, stabilized polyvinylchloride, kraft paper, and reinforced cardboard; and the tape is bonded to the sheet with an adhesive.

3. A package comprising at least one article, a sheet of heat shrunk polymeric material about the article, a length of tape bonded to one of the interior or exterior surfaces of the polymeric material, and openings in the heat shrunk polymeric material along a central portion of the tape so that the central portion of the tape adjacent the openings provides a handle for the package, said openings having substantial widths in directions normal to the longitudinal edges of the tape to afford easy access to said handle.

* * * * *

UNITED STATES PATENT AND TRADEMARK OFFICE

CERTIFICATE OF CORRECTION

PATENT NO. : 4,830,895

DATED : May 16, 1989

INVENTOR(S) : Emile C. Bernard

It is certified that error appears in the above-identified patent and that said Letters Patent is hereby corrected as shown below:

Col. 2, line 36, "adjccent" should read--adjacent--.

Signed and Sealed this

Twenty-sixth Day of June, 1990

*Attest:*

HARRY F. MANBECK, JR.

*Attesting Officer*

*Commissioner of Patents and Trademarks*